United States Patent [19]

Takahashi et al.

[11] Patent Number: 4,711,620

[45] Date of Patent: Dec. 8, 1987

[54] MOVING VANE TYPE COMPRESSOR

[75] Inventors: Yukio Takahashi; Isao Hayase, both of Katsuta; Keijirou Amano, Mito; Masao Mizukami; Masaaki Ishiguri, both of Katsuta, all of Japan

[73] Assignees: Hitachi, Ltd., Tokyo; Hitachi Automotive Engineering Co., Ltd., Katsuta, both of Japan

[21] Appl. No.: 738,266

[22] Filed: May 28, 1985

[30] Foreign Application Priority Data

May 28, 1984 [JP] Japan ..... 59-106617

[51] Int. Cl.[4] ..... F04C 18/344

[52] U.S. Cl. ..... 418/96; 418/76; 418/97; 418/179; 418/268

[58] Field of Search ..... 418/96-99, 418/178, 179, 268, 270, 76

[56] References Cited

U.S. PATENT DOCUMENTS

| | | | |
|---|---|---|---|
| 3,622,254 | 11/1971 | LeBlanc | 418/179 |
| 3,743,453 | 7/1973 | Abendschein | 418/97 |
| 3,834,846 | 9/1974 | Linder | 418/270 |
| 4,224,014 | 9/1980 | Glanvall | 418/76 |
| 4,269,576 | 5/1981 | Shibuya | 418/97 |
| 4,510,659 | 4/1985 | Okazaki | 418/270 |

FOREIGN PATENT DOCUMENTS 146094 9/1982 Japan .

*Primary Examiner*—Carlton R. Croyle
*Assistant Examiner*—Jane E. Obee
*Attorney, Agent, or Firm*—Antonelli, Terry & Wands

[57] ABSTRACT

A moving vane type compressor has a cylinder which is made of a sintered material having a density of 6.6 to 7.6 and a composition consisting essentially of 0.6 to 0.8% of carbon, 1 to 2% of copper and the balance substantially iron. The cylinder is encased by a hermetic casing therebetween a high pressure chamber into which a refrigerant compressed by the compressor is discharged. Lubricating oil separated from the discharged refrigerant within the high pressure chamber and the lubricating oil suspended in the form of a mist by the refrigerant attach to the outer peripheral surface of the wall of the cylinder made of the sintered material. The oil attaching to the outer peripheral surface of the cylinder is forced by the refrigerant pressure acting thereon into the pores of the sintered material such as to block these pores, thus preventing the compressed gas in the cylinder from leaking outside through the pores.

1 Claim, 5 Drawing Figures

MOVING VANE TYPE COMPRESSOR

BACKGROUND OF THE INVENTION

The present invention relates to a moving vane type compressor suited to use particularly in such fields as requiring light-weight compressors of this type.

To reduce the total weight of a compressor in, for example, U.S. Pat. No. 3,312,382, a moving vane type compressor is proposed having a rotor made of aluminum or a sintered material in order to reduce the total weight of the compressor.

However, the sintered material cannot be used as the material of the cylinder of the compressor because the internal pores of the sintered material, when used as the material of the cylinder, undesirably permit an external leak of the gas compressed in the compressor through the pores. The cylinder has to have a wear resistance large enough to sustain the friction with the moving vanes. Therefore, the cylinders of the compressors of this type are produced by casting from ferrous material and the inner peripheral surfaces finely are polished after quenching.

The cylinder made by casting from a ferrous material has a considerably heavy weight, thus making it difficult to reduce the total weight of the compressor. In addition, a long time is required for the polishing of the inner peripheral surface of the cylinder.

Accordingly, an object of the invention is to make it possible to use a light-weight sintered alloy as the material of the cylinder which houses a compressed fluid.

To this end, according to the invention, a liquid is supplied from the outer peripheral surface of the cylinder made of a sintered metallic material into the pores of the sintered metallic material such as to block these pores, thus preventing external leak of the fluid compressed in the cylinder through the pores. Thus, the invention makes it possible to use a light-weight sintered alloy as the material of the cylinder, so that the weight of the cylinder and, hence, the total weight of the compressor can be reduced advantageously.

DETAILED DESCRIPTION

Figure 1:
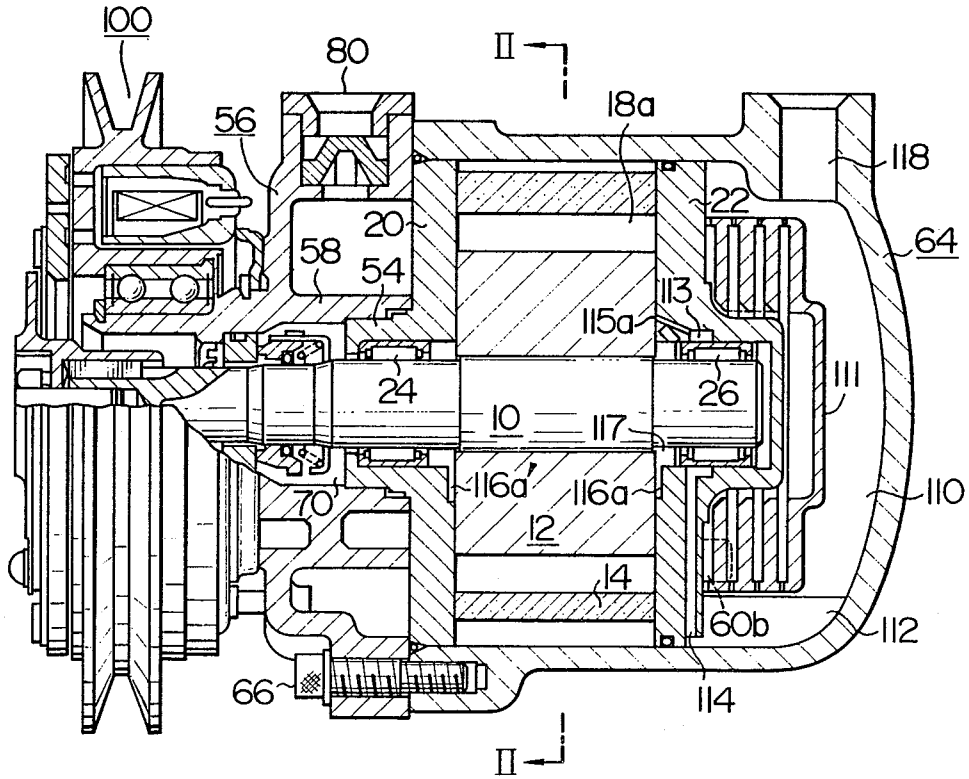
FIG. 1 is a partial longitudinal cross-sectional view of a vane type compressor constructed in accordance with the present invention taken along the line I—I in FIG. 2.
Figure 2:
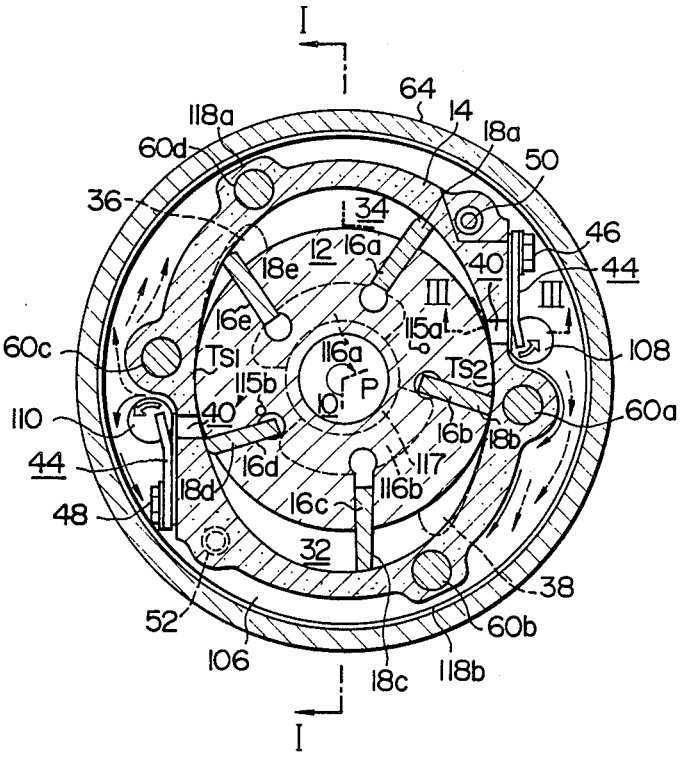
FIG. 2 is a cross-sectional view taken along line II—II in FIG. 1.
Figure 3:
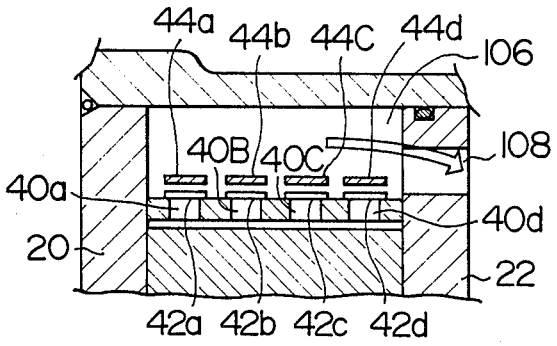
FIG. 3 is a cross-sectional view taken along line III—III in FIG. 2.

Referring now to the drawings wherein like reference numerals are used throughout the various views to designate like parts and, more particularly, to FIGS. 1-3, according to these figures, a two-lobe moving vane compressor having five vanes for use in, for example, an air conditioner for a motor vehicle, includes a rotor shaft 10 adapted to be driven by an automotive engine through an electromagnetic clutch 100, with the rotor shaft 10 fixedly carrying a rotor 12 received by a cam cylinder 14.

As shown most clearly in FIG. 2, the cross-section of the rotor perpendicular to the axis has a circular outer configuration concentric with the rotor shaft 10, and the cross section of the cam cylinder 14, perpendicular to the axis, has an oval inner peripheral configuration which is contacted by the rotor 12 at two tangential sealing points Ts1 and Ts2. The oval shape of the inner periphery of the cam cylinder can be represented by an epitrocoidal curve.

The rotor 12 is provided with a plurality of radially extending vane grooves **16*a* to 16*e* for respectively receiving vanes 18*a* to 18*e* for radial sliding motion into and out of these grooves. The vanes 18*a* to 18*e* are adapted to be rotated together with the rotor 12 while making sliding contact with the inner peripheral surface of the cam cylinder 14**.

A pair of side plates 20 and 22 are attached to respective axial open ends of the cam cylinder 14 so as to substantially hermetically seal the interior of the cam cylinder 14, with bearings 24 and 26, which rotatably carry the rotor shaft 10, being provided at a central portion of the respective side plates 20, 22. The side plates 20, 22 are located with respect to the cam cylinder 14 and temporarily fixed to the same by knock pins 50, 52.

Two working chambers 32 and 34 are formed within the cam cylinder 14, by the outer peripheral surface of the rotor 12, inner peripheral surface of the cam cylinder 14 and the inner surfaces of the side plates 20 and 22, with the volumes of the working chambers 32, 34 being progressively changed as the vanes **18*a*-18*e* rotate together with the rotor 12**.

Suction ports 36 and 38 are formed in the side plate 20 for communication with the working chambers 32 and 34, with the positions of the suction ports 36 and 38 being selected within the regions in which the vanes **18*a* to 18*e* which have passed the tangential sealing points Ts1 and Ts2, where the clearance between the rotor 10 and the cam cylinder 14 is minimized, move radially outwardly in their vane grooves 18*a* to 18*e***, i.e., in the regions where the volumes of compression chambers formed between adjacent vanes are increasing.

As will be seen from FIGS. 2 and 3, discharge ports **40*a* to 40*d*, leading to the working chambers 32 and 34, are formed in the wall of the cam cylinder 14, and reed valves 42*a* to 42*d* and valve seats 44*a* to 44*d* are associated with these discharge ports 40*a* to 40*d*. The reed valves 42*a*–42*d* and the valve seats 44*a*–44*d* have comb-teeth-like forms (not shown) and are secured at their base ends to the outer surface of the wall of the cam cylinder 14 by screws 46, 48**.

A boss 54 for holding the bearing 24 projects outwardly from the center of the outer surface of the side plate 20 so as to surround the rotor shaft 10 and a side cover 56 is secured to a side surface of the side plate 20.

A cylindrical portion 58, defining the shaft seal chamber 70, is formed in the center of the side cover 56 and makes a spigot fit at the end of the inner peripheral surface thereof to the outer peripheral surface of the boss 54 on the side plate 20.

Screws **60*a* to 60*d* are screwed into threaded holes (not shown) formed in the inner surface of the side cover 56 through corresponding bores formed in the side plate 22, cam cylinder 14 and the side plate 20**.

Thus, the compressor assembly constituted by the side plates 20 and 22 and the cam cylinder 14 clamped therebetween is fixed to the side cover 56.

In assembling, the compressor assembly is inserted into a bowl-shaped casing 64 through an open end of the latter and then the rear side cover 56 and the casing 64 are fixed together by means of screws 66.

A shaft seal chamber 70 receives a rotary ring 72 fixed to the rotor shaft 10 for rotation therewith, and a spring 76 which acts to press the rotary ring 72 onto a stationary ring 74 which is fixed to the inner wall of the shaft seal chamber 70.

A suction opening 80, formed in an outer peripheral portion of the side cover 56, is communicated with the pipe (not shown) of the low-pressure side of the refrigerating cycle through a check valve 82 which prevents the compressed fluid from flowing back from the compressor to the low-pressure side of the refrigerating cycle when the compressor is not operating.

Although not illustrated, the suction opening 80 is oriented such that the refrigerant sucked therethrough is directed substantially in the tangential direction to the cylindrical wall in the direction of rotation of the rotor.

On the other hand, a refrigerant passage 90 having a closed end is formed in the inner wall surface of the side cover 56 such as to extend around the cylindrical portion 58 in the direction opposite to the direction of rotation of the rotor 12.

Consequently, the low-pressure refrigerant introduced through the suction opening 80 flows into the refrigerant passage 90 while making a 90° turn and then introduced into the working chambers 34 and 32 through the suction ports 36 and 38.

The moving vane type compressor of the invention having the described construction operates in a manner which will be explained hereinunder.

As a result of the rotation of the rotor 12 in the direction of the arrow P, each vane 18 makes one cycle of reciprocatory motion into and out of the associated vane groove, while it moves from one tangential sealing point Ts1 (Ts2) to the other tangential sealing point Ts2 (Ts1) where the clearance between the rotor 12 and the cylinder 14 is minimized.

In the period between the moment at which a leading vane **18*c* (18*e*) has passed a suction port 38 (36) and the moment at which the trailing vane 18*b* (18*d*) has passed the same suction port 38 (36, the portion of the working chamber 32 (34) between these two vanes 18*c* and 18*b* (18*e* and 18*d*) is in its suction stroke. The volume of this portion of the working chamber, formed between these two vanes 18*c* and 18*b* (18*e* and 18*d*) is progressively decreased until the leading vane 18*c* (18*e*) comes to cross a discharge port 40 (40'), so that this portion of the working chamber performs its compression stroke. In the period between the moment at which the leading vane 18*c* (18*e*) has passed the discharge port 40 (40') and the moment at which the trailing vane 18*b* (18*d*) has passed the same discharge port 40 (40'**), the portion of the working chamber between these two vanes performs its discharging stroke.

Consequently, the refrigerant is sucked from the low-pressure side of the refrigerating cycle into the working chamber 32 through the suction opening 80, refrigerant passage 90 and the suction port 38 and is compressed and discharged into a discharge chamber 110 through the discharge port 40, discharge space 106, and a passage hole 108 formed in the side plate 22.

An oil separator of the type disclosed in Japanese Patent Laid-Open No. 146094/1982 is disposed in the discharge chamber 110 so as to separate the lubricating oil from the refrigerant discharged to the discharge chamber 110. The separated oil is stored in an oil reservoir which is formed in a lower portion of the chamber 110. This oil is fed to the small space formed between the end surfaces of the rotor 12 and the side plate 22, through an oil passage 114, an annular groove 113 formed between the outer race of the needle bearing 26 and the side plate 22, and oil passages **115*a* (115*b*) of a small diameter and having one end opened in the surface of the side plate 22 adjacent the rotor 12 and the other end opening in the annular groove 113**.

A portion of the oil supplied to this small clearance then flows radially inwardly of the rotor 12 and is supplied to the semi-circular grooves **116*a* and 116*b* through an annular groove 117 formed in the surface of the side plate 22 adjacent the rotor. The annular groove 117** is a recess which is intended for receiving a needle bearing.

The semi-circular grooves **116*a* and 116*b* are allowed to communicate with the bottoms of the vane grooves 16*a* to 16*e* over the period immediately after the corresponding vanes 18*a* to 18*e*** passed the tangential sealing points and immediately before the vanes reaches the discharge port.

The pressure of the oil supplied to the semcircular groove 116a and 116b through the oil passages **115*a* and 115*b* of small diameter and then through the small clearance between the end surfaces of the rotor and the side plate has been reduced almost to 8 $Kg/cm^2$ when the oil reaches the semi-circular grooves 116*a* and 116*b*. Consequently, when the vane grooves 16*a* to 16*e* are held in communication with the semi-circular grooves 115*a* and 115*b*, the vanes 18*a* to 18*e*** associated with such vane grooves, are pressed radially outwardly at their radially inner ends at a pressure of about 8 $Kg/cm^2$.

The oil passages **115*a* and 115*b* of small diameter open to the regions devoid of the semi-circular grooves 116*a* and 116*b* so as to be communicated with the vane grooves 18*a* to 18*e* in the period between the moment at which the associated vanes 18*a* to 18*e* are just reaching the discharge port and a moment at which these vanes are just reaching the tangential sealing point Ts1 (Ts2). These oil passages 115*a* to 115*b* of small diameter do not produce substantial pressure reducing effect. Thus, the pressure at the outlets of these passages 115*a* and 115*b* is almost equal to or about 1 $Kg/cm^2$ below the pressure in the discharge chamber. Consequently, the pressure in the discharge chamber 110 of about 14 $Kg/cm^2$ for example is applied to the radially inner ends of the vanes 18*a* to 18*d* while the associated vane grooves 16*a* to 16*e* are in communication with the oil passages 115*a* and 115*b***.

The application of the high pressure to the radially inner ends of the vanes prevents the vanes from being forced back inwardly by high pressure which is generated on the radially outer ends of these vanes when the vanes are just going into closing chamber which is formed between the discharge port and the tangential sealing point, thus preventing unfavorable chattering of the vanes.

When the vanes **18*a* to 18*e* are passing the tangential sealing points Ts1 and Ts2, the associated vane grooves 16*a* to 16*e* do not communicate with the passages 115*a* and 115*b* of small diameter nor with the semi-circular grooves 116*a* and 116*b*. Therefore, when the vanes 18*a* to 18*b* passing the tangential sealing points Ts1 and Ts2 are pressed radially inwardly, the oil confined in the vane grooves 16*a* to 16*e*** is compressed so as to provide a cushioning effect to prevent a rapid inward movement of the vanes. In addition, the pressure of the confined oil produces a force which effectively presses the vanes onto the inner peripheral surface of the cylinder even after the vane has passed the tangential sealing point Ts1 and Ts2, thus avoiding the risk of chattering also in the case.

The oil supplied to the vane grooves 16*a* to 16*e* is supplied also to the needle bearing 24 and the shaft seal chamber 70 through semi-circular grooves 116*a'* and 116*b'* (not shown) formed in the side plate 20, thereby lubricating various sliding parts requiring lubrication.

On the other hand, the remainder part of the oil supplied to the space between the end surfaces of the rotor 12 and the side plate 22 through the oil passages 115*a* and 115*b* of small passage flows radially outwardly through this space so as to lubricate these surfaces, and is then introduced into the working chambers 32 and 34.

A part of the oil thus supplied to the compression chambers is disengaged together with the refrigerant into the discharge chamber 106 through the discharge ports 40 and 40'. A fraction of this oil is separated from the refrigerant and stays in the discharge chamber 106. This fraction of oil, however, is evaporated sooner or later and is sent together with the discharged refrigerant to the oil separator 111 through the passage hole 108 formed in the side plate 22. The oil is separated from the compressed refrigerant by the operation of the oil separator 111 and is collected in the oil reservoir 112.

In this embodiment, the cylinder 14 is made of a sintered material having a density of 6.6 to 7.6 and a composition which essentially consists of 0.6 to 0.8% of carbon, 1 to 2% of copper and the balance substantially iron.

It has been generally considered that sintered alloy such as that mentioned above cannot be used as the material of a pressure vessel because of the possibility of leak of the fluid through the pores. According to the invention, however, the cylinder can be formed of the sintered material without the risk of the leak of the compressed refrigerant gas. Namely, in the compressor of the invention, the cylinder 14 is encased by the casing 64 such that the discharge chamber 106, in which the high pressure of the discharged refrigerant is maintained, is formed between the outer peripheral surface of the cylinder 14 and the inner peripheral surface of the casing 64. In addition, the lubricating oil which has been separated from the discharged refrigerant within the discharge chamber 106, as well as the lubricating oil suspended in the form of a mist by the refrigerant, attaches to the outer peripheral surface of the cylinder 14. The lubricating oil on the outer peripheral surface of the cylinder 14 is forced into the pores of the sintered material constituting the wall of the cylinder 14 by the high pressure of the discharged refrigerant acting on this surface of the cylinder 14. Consequently, the refrigerant gas which is being compressed in the compressor is prevented from leaking outside through these pores in the sintered alloy constituting the cylinder 14.

The pressure in the portions of the working chambers in their suction strokes is much lower than that in the discharge chamber. Therefore, the oil, forced into the pores, progressively penetrates inwardly of the wall of the cylinder 14 and comes to exude from the inner peripheral surface of the cylinder 14. The oil exuding from the inner peripheral surface of the cylinder 14, although its amount is not so large, is mixed with the compressed refrigerant gas together with the oil which has been introduced into the working chambers through the clearance between the end surfaces of the rotor 12 and the side palte 22. The mixture of the refrigerant gas and the oil is then discharged through the discharge ports 40 and 40' into the discharge chamber 106 where a portion of the oil is separated from the refrigerant and stored in the discharge chamber 106 such as to be used again as the liquid for blocking the pores of the sintered material in the manner described before.

The mixture of refrigerant gas and lubricating oil discharged through the discharge ports 40, 40' is at a high temperature in pressure since the mixture has just been compressed by the compressor. The fluid, formed by the refrigerant gas and lubricating oil and discharged from the discharge ports 40, 40' is introduced into the discharge chamber 106 through the discharge valve, with the lubricating oil being suspended in the form of a mist or gas. The flow of fluid has a very high velocity and is in a state of a turbulent flow. The passage port or hole 108, formed in a side plate, provides a communication between a discharge space 106 and a discharge chamber 110. Only a small portion of the fluid from the discharge ports 40, 40' directly reaches the passage port or hole 108. More particularly, the greater portion of the fluid collides with the structural parts within the discharge chamber 106 such as, for example, the walls of the cylinder 14 and the inner surface of the wall defining the discharge chamber 106, so that the flow of velocity is sufficiently reduced prior to reaching the passage port or hole 108. When the fluid containing the lubricating oil collides with the walls of the cylinder 14 and the wall defining the discharge chamber 106, the lubricating oil is separated from the refrigerant gas and attaches to these walls for the following reasons.

The first reason relates to the difference in the specific weight between the lubricating oil and the refrigerant gas. When the flowing direction of the fluid is drastically changed due to a collision of the fluid on a wall surface, a large difference in the inertial force is caused between the lubricating oil in the refrigerant gas due to the difference in the force of inertia thereby causing the lubricating oil to be separated from the refrigerant gas. A further reason resides in the fact that there is a difference in the viscosity between the lubricating oil and the refrigerant gas, which difference is caused in a viscosity resistance between the lubricating oil and the refrigerant gas when the flow of fluid sharply or drastically turns upon collision with a wall or other structural portion of the compressor. This action, in turn, creates a difference in the flow velocity between the lubricating oil and the refrigerant gas so that the lubricating oil is separated from the refrigerant gas and remains on the wall surface.

The major portion of the fluid from the discharge ports 40, 40' undergoes the oil separating action; however, the remaining small portion of the fluid does not collide with the structural parts of the compressor. The kinetic energy possessed by the small portion of the fluid is lost as it forms eddy currents in the turbulent flow of the fluid so that the flow velocity of the small portion of the fluid is also decreased. The decelerated small portion of the fluid is then mixed with the refrigerant gas which has collided with the structural parts and thus forms a mixture fluid which is discharged through the passage hole or port 108. Consequently, the fluid from the passage hole or port 108 still contains lubricating oil. The fluid is then introduced into the chamber 110 through the oil separator 111 in which a further separation of the lubricating oil is effected. Thus, the lubricating oil is separated from the refrigerant gas and attaches to the wall of the oil separator 111 and then drips into the oil reservoir 112 formed in the lower portion of the discharge chamber 110 through the force of gravity.

Meanwhile, the lubricating oil separated from the compressed gas and attached to the walls of the cylinder 14 in the discharge chamber 106 has a high temperature and, consequently, a low viscosity, that is, a high fluidity. In this state, a high pressure is maintained in the discharge chamber 106 since the discharge chamber 106 is supplied with compressed fluid. An interior of the cylinder 14, that is, the rotor side of the same, is supplied through the port 36 with a fluid of low pressure and temperature from an evaporator of an air conditioner system. The thus introduced fluid is gradually compressed as the volume of the compression chamber is increased in accordance with a rotation of the rotor 12 so that the pressure inside the cylinder 14 is gradually increased. Thus, the pressure and temperature inside the cylinder 14 are lower than the temperature and pressure outside the cylinder 14 over almost an entire area of the cylinder 14. Consequently, the oil attaching to the outer surface of the cylinder 14, that is, the surface adjacent to the discharge chamber 106, gradually permeates through pores of the sintered cylinder 14 from the surface adjacent to the discharge chamber 106 toward the surface adjacent to the rotor 12 due to the pressure differential existing across the wall of the cylinder 14. As the lubricating oil approaches the inner surface of the wall of the cylinder 14 where the temperature and pressure are low, the viscosity of the lubricating oil is gradually increased so that the fluidity of the lubricating oil is reduced. It is due in part to the reduced fluidity, in part to the resistance produced by the fluidity, as well as in part to the resistance produced by the fine pores, that the lubricating oil is held within the wall of the cylinder 14 at a relatively high concentration particularly in a thickness area near the surface adjacent to the rotor 12. The lubricating oil effectively blocks the pores thus serving as a sealant thereby enabling the sintered material to be used as a material of the cylinder 14 in a compressor of the above-described type.

The liquid for blocking the pores is not limited to the lubricating oil used in the compressor, although the use of the lubricating oil is advantageous in that both the lubricating effect and blocking effect are achieved simultaneously.

For attaining a high pore blocking effect the liquid preferably has a high viscosity. From this point of view, it is advisable to use ATMOS S 150 which is one of mineral oils of paraffin system produced by Nippon Sekiyu (Nippon Oil Company, Limited), although other paraffin mineral oils having lower viscosity such as HTS 750 produced by Showa Sekiyu (Showa Oil Co., Ltd.) and naphthene mineral oils such as Suniso 3GS to 5GS produced by Nippon Sun Oil have been confirmed as being usable satisfactorily.

In the described embodiment, in order to allow the pore blocking liquid to be distributed uniformly over the entire surface of the cylinder 14, radial extremities of the radial projections on the outer surface of the cylinder 14 are cut to provide circumferential liquid passages 118*a* and 118*b* as shown in FIG. 2. Consequently, a part of the mixture formed of the oil and refrigerant discharged from the discharge ports 40 and 40' flows slowly around the cylinder 14 in a clockwise direction.

It is not possible to maintain the pores in the blocked state for a long period of time solely by the oil collected in the discharge chamber. In the described embodiment, therefore, the oil stored in the chamber 110 within the casing 64 is supplied to the working chambers 32 and 34 through the oil passages 114, annular groove 113, oil passages 115*a*, 115*b* of small diameter and the small gap between the end surfaces of the rotor 12 and the side plate 22, thus preventing any shortage of oil in the sintered material constituting the wall of the cylinder.

In the described embodiment, the sintered material constituting the cylinder contains copper so that the porosity is decreased without being accompanied by any substantial reduction in the hardness.

In addition, the oil exuding from the inner peripheral surface of the cylinder functions to reduce the friction between the ends of the vanes and the inner peripheral surface of the cylinder.

It is to be understood also that the cylinder used in the compressor of the invention, made from the sintered material, does not require any finish polishing of the inner peripheral surface, unlike the conventional cylinder made of an Fe-C system material. If the sintered material used as the material of the cylinder has a large thermal expansion coefficient, the gaps at the tangential sealing points are increased in the hot state of the compressor and decreased in the cold state of the same. In this case, therefore, it is possible to improve the efficiency of the compressor in the cold state, while suppressing the capacity of the compressor in the hot state.

Figure 4:
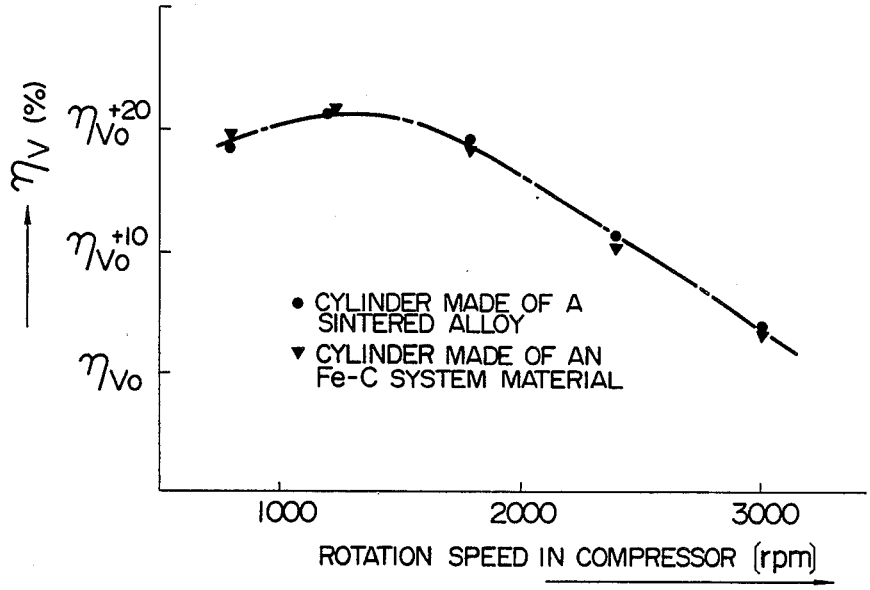
FIGS. 4 and 5 are graphical illustrations of the performance of the compressor in accordance with the present invention in comparison with the performance of a conventional compressor.
Figure 5:
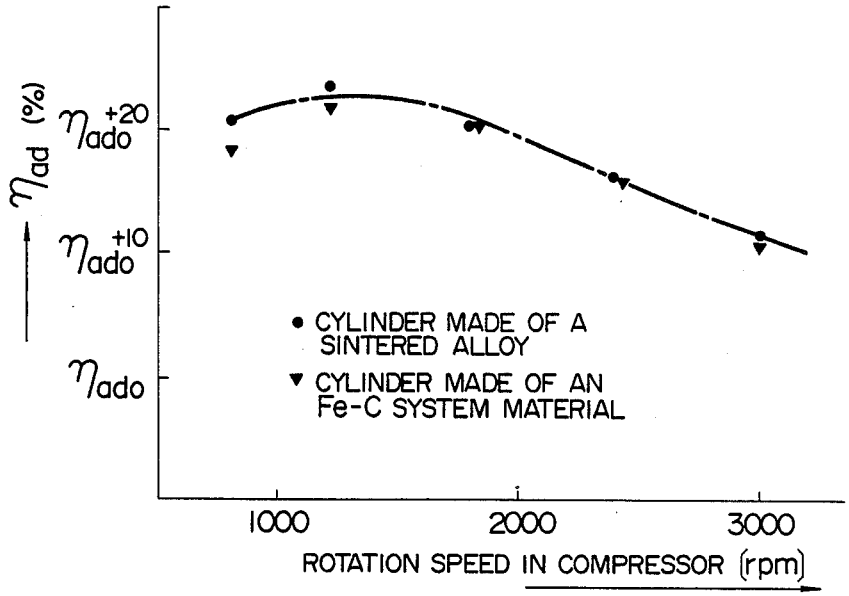

FIGS. 4 and 5 in combination show the performance of the compressor in accordance with the invention having a cylinder made of a sintered alloy and making use of Suniso 5GS (made by Nippon Sun Oil) as the pore blocking liquid, in comparison with the performance of a conventional compressor having a cylinder made of an Fe-C system material.

More specifically, FIG. 4 shows the change in the volumetric efficiency $\eta v$ in relation to the rotation speed, while FIG. 5 shows the change in the adiabatic efficiency $\eta ad$ in relation to rotation speed in both compressors.

From FIGS. 4 and 5, it will be seen that the compressor of the invention exhibits performance which is equivalent to that of the conventional compressor both in the volumetric efficiency $\eta v$ and adiabatic efficiency $\eta ad$.

In the described embodiment, the green sintered material for use as the material of the cylinder has been subjected to quenching such as to improve the hardness including the bonding strength between the particles of the material rather than the hardness of the particles themselves, so that a wear resistance equivalent to or higher than that of the Fe-C system material is ensured.

It has been known that the blocking of the pores in sintered materials can be effected by subjecting the green sintered material to a steaming treatment. Unfortunately, however, it is not allowed to subject the steamed green sintered material to quenching which is essential for attaining a high wear resistance.

According to the invention, however, it is allowed to subject the green sintered material to quenching and, hence, to attain a high wear resistance, because the blockage of the pores is effected by forcing a liquid into the pores, without requiring any steaming beforehand. Consequently, the blockage of the pores can be effected while improving the wear resistance, thus allowing the light-weight sintered materials to be used as the material of the compressor cylinder.

The impregnation of the pores of the sintered material constituting the cylinder may be conducted by dipping the cylinder in an oil bath in advance of the assembly or, alternatively, the chamber in the casing is initially charged with oil in excess of the amount required for the lubrication so that the excessive oil progressively penetrates into the porous sintered material during the running-in period of the compressor operation.

What is claimed is:

1. A moving vane type compressor for an automotive air conditioner comprising: a rotor fixed to a rotor shaft; a cylinder having an inner peripheral surface surrounding an outer peripheral surface of said rotor and of a curvature different from that of the outer peripheral surface of said rotor; a pair of side plates on both end surfaces of said cylinder and substantially hermetically sealing an interior of said cylinder; and vanes respectively slidably received in a plurality of radially extending vane grooves formed in said rotor and adapted to be moved into and out of said vane grooves while rotating together with said rotor in sliding contact with the inner peripheral surface of said cylinder, said rotor, said cylinder, said side plates and said vanes in cooperation defining work chambers volumes of which are changed as a result of movement of said vanes into and out of said vane grooves such that a gas is drawn into said working chambers and compressed and then discharged from said working chambers, of a sintered alloy having a plurality of pores; a blocking liquid is supplied from the outer peripheral surface of said cylinder into said pores so as to block said pores, said blocking liquid being a lubricating oil; a casing for cooperating with said cylinder and said side plates for defining a chamber for holding said lubricating oil on the outer peripheral surface of said cylinder so that the lubricating oil blocks said pores of the sintered alloy of the cylinder and to prevent a leakage of compressed gas out of said cylinder; a liquid separating means separating said liquid from said compressed gas when said compressed gas is discharged to the interior of said casing; and for collecting said liquid in said chamber reserving said liquid and a liquid collecting and supply means is provided for supplying said liquid into said pores of said sintered alloy constituting said cylinder from the outer peripheral surface of said cylinder.

* * * * *